US008281504B2

(12) United States Patent
Morita et al.

(10) Patent No.: US 8,281,504 B2
(45) Date of Patent: Oct. 9, 2012

(54) INNER SOLE FOR A FOOTWEAR

(75) Inventors: Nobuyoshi Morita, Shizuoka (JP); Junichi Takano, Kanagawa (JP)

(73) Assignees: Nobuyoshi Morita, Hamamatsu-shi (JP); Walking Day Co., Ltd., Yokohama-shi (JP); Daimatu Inc., Shizuoka-shi (JP)

( * ) Notice: Subject to any disclaimer, the term of this patent is extended or adjusted under 35 U.S.C. 154(b) by 0 days.

(21) Appl. No.: 12/270,900

(22) Filed: Nov. 14, 2008

(65) Prior Publication Data

US 2009/0126226 A1 May 21, 2009

Related U.S. Application Data

(63) Continuation of application No. PCT/JP2007/000521, filed on May 15, 2007.

(30) Foreign Application Priority Data

May 15, 2006 (JP) ..... 2006-134853

(51) Int. Cl.
*A43B 7/14* (2006.01)
*A43B 13/38* (2006.01)

(52) U.S. Cl. ..... 36/153; 36/43

(58) Field of Classification Search ..... 36/153, 36/43, 29, 154, 28, 71
See application file for complete search history.

(56) References Cited

U.S. PATENT DOCUMENTS

| | | | | | |
|---|---|---|---|---|---|
| 4,123,855 | A | * | 11/1978 | Thedford | 36/44 |
| 5,733,647 | A | * | 3/1998 | Moore et al. | 428/304.4 |
| 5,878,510 | A | * | 3/1999 | Schoesler | 36/43 |
| 5,979,086 | A | * | 11/1999 | Vindriis | 36/153 |
| 6,021,585 | A | * | 2/2000 | Cole | 36/11.5 |
| 6,138,382 | A | * | 10/2000 | Schoesler | 36/43 |

FOREIGN PATENT DOCUMENTS

| | | |
|---|---|---|
| JP | 56-70806 | 6/1981 |
| JP | 59-008565 | 3/1984 |
| JP | 60-72501 | 4/1985 |
| JP | 08-187108 | 7/1996 |
| JP | 10-033204 | 2/1998 |
| JP | 3114776 | 9/2005 |
| JP | 2006-102342 | 4/2006 |

* cited by examiner

*Primary Examiner* — Ted Kavanaugh
(74) *Attorney, Agent, or Firm* — Harness, Dickey & Pierce, P.L.C.

(57) ABSTRACT

An inner sole for an insole has a body made of flexible material and adapted to be laid on an insole of a shoe. Liquid containing spaces are formed in the body of the inner sole for sealingly and flowably containing liquid. Dam portions divide the liquid containing spaces into a toe region, a heel region and a middle region between the two. Orifices communicate the liquid between mutually adjacent regions. The orifice formed by the dam portions that divides the liquid containing spaces into the heel region and the middle region opens toward one side edge portion to cause an eddy of liquid, flowing from the heel region into the middle region, that substantially fills the whole middle region.

8 Claims, 15 Drawing Sheets

INNER SOLE FOR A FOOTWEAR

CROSS-REFERENCE TO RELATED APPLICATIONS

This application is a continuation of International Application No. PCT/JP2007/000521, filed May 15, 2007, which claims priority to Japanese Application No. 2006-134853, filed May 15, 2006. The disclosures of the above applications are incorporated herein by reference.

FIELD

The present disclosure relates to an inner sole for footwear to be laid on an insole of a shoe.

BACKGROUND

Previously proposed inner soles to be laid on an insole in order to absorb shock applied to the sole of a foot of a walker or wearer of the inner sole are illustrated in Japanese Laid-open Patent Publication No. 197504/2000. This inner sole is made of a flexible covering material and has a space where liquid is flowably contained in a sealed manner. The inner sole has a slight inflation of the flexible covering material as well as a pressing effect against the sole of a foot of a walker caused by the flow of liquid.

However since the inner sole of the prior art only has one liquid containing space formed by the covering material continuous over its whole region; it is difficult to cause an ideal movement of liquid during walking. Thus, it is impossible to have a sufficient shock absorbing effect and pressing effect against the sole of a foot of a walker.

SUMMARY

A gap is usually generated between the inner sole and the arch of a foot of a walker. However, the gap cannot be sufficiently filled by the inner sole of the prior art and thus the pressing effect against the arch of a foot is also insufficient. This is due to the inner sole of the prior art having only one continuous liquid containing space. The liquid tends to rapidly flow from the heel region to the toe region through the middle region (especially the arch region of a foot) without staying in the middle region.

It is, therefore, an object of the present disclosure to provide an inner sole for an insole which can provide excellent shock absorbing effect and pressing effect against the sole of a foot of a walker.

According to the present disclosure, an inner sole for footwear comprises a body of the footwear. Liquid containing spaces are formed in the body of the footwear to sealingly and flowably contain liquid. Dam portions divide the liquid containing spaces into a toe region, a heel region and a middle region between the two. Orifices communicate the liquid between mutually adjacent regions. The orifice formed by the dam portions that divide the liquid containing spaces into the heel region and the middle region opens toward one of the side edge portions of the body of the footwear. This causes an eddy of liquid flowing from the heel region into the middle region that substantially fills the entire middle region. The body of the footwear is a sandal.

An inner sole for an insole comprises a body of the inner sole made of flexible material and adapted to be laid on the insole of a shoe. Liquid containing spaces are formed in the body of inner sole to sealingly and flowably contain liquid. Dam portions divide the liquid containing spaces into a toe region, a heel region and a middle region between the two. Orifices communicate the liquid between mutually adjacent regions. The orifice formed by the dam portions that divide the liquid containing spaces into the heel region and the middle region opens toward one of the side edge portions. This causes an eddy of liquid to flow from the heel region into the middle region that substantially fills the whole middle region.

The orifice formed by the dam portions to divide the liquid containing spaces into the heel region and the middle region opens toward a position near the side edge portion. This corresponds to a shank portion of a shoe on which the inner sole is laid. The body of inner sole is made of a flexible sheet of synthetic resin. The liquid is water or a mixture of water and polyhydric alcohol. The body of inner sole is fit into a cup-inner sole having any three-dimensional configuration adapted to be laid on an insole of a shoe. An inner sole is provided for footwear where the body of inner sole is integrated with the insole of the footwear.

An ideal liquid shift to necessary portions can be realized in accordance with walking timing. Thus, it is possible to achieve a sufficient shock absorbing effect against the sole of a foot of a walker. The eddy of liquid flowing from the heel region to the middle region substantially fills the whole middle region. Thus, it is possible to sufficiently inflate the necessary portions of the inner sole in its thickness, vertical direction. This provides a pressing effect against the sole of a foot of a walker.

The orifice formed by the dam portions that divide the liquid containing spaces into the heel region and the middle region opens toward a position near the side edge portion that corresponds to a shank portion of a shoe where the inner sole is laid. Thus, it is possible to further improve the pressing effect against the sole of a foot of a walker.

The body of inner sole is made of a flexible sheet of synthetic resin. Thus, it is possible to smoothly cause the vertical inflation of the inner sole in accordance with the shift of liquid. This easily and firmly obtains the pressing effect against the sole of a foot of a walker. In addition, it is easy to form the dam portions in the flexible sheet of synthetic resin. Also, it is easy to cut the sheet into a desirable outline of the inner sole.

The liquid is a water or mixture of water and polyhydric alcohol. If the liquid is water, it is possible to manufacture the inner sole at a low cost. If the liquid is a mixture of water and polyhydric alcohol, it is possible to prevent freezing of the liquid within the inner sole. Also, it is possible to suppress evaporation of the liquid through the body of the inner sole during long term use.

The body of inner sole is fit into a cup-inner sole with any three-dimensional configuration adapted to be laid on an insole of a shoe. Thus, it is possible to further improve the pressing effect against the sole of a foot of a walker at any position defined by the three-dimensional configuration of the cup-inner sole.

Further areas of applicability will become apparent from the description provided herein. The description and specific examples in this summary are intended for purposes of illustration only and are not intended to limit the scope of the present disclosure.

DRAWINGS

Additional advantages and features of the present disclosure will become apparent from the subsequent description and the appended claims, taken in conjunction with the accompanying drawings, wherein:

DETAILED DESCRIPTION

A preferred embodiment of the present disclosure will be described with reference to accompanying drawings.

Figure 1:
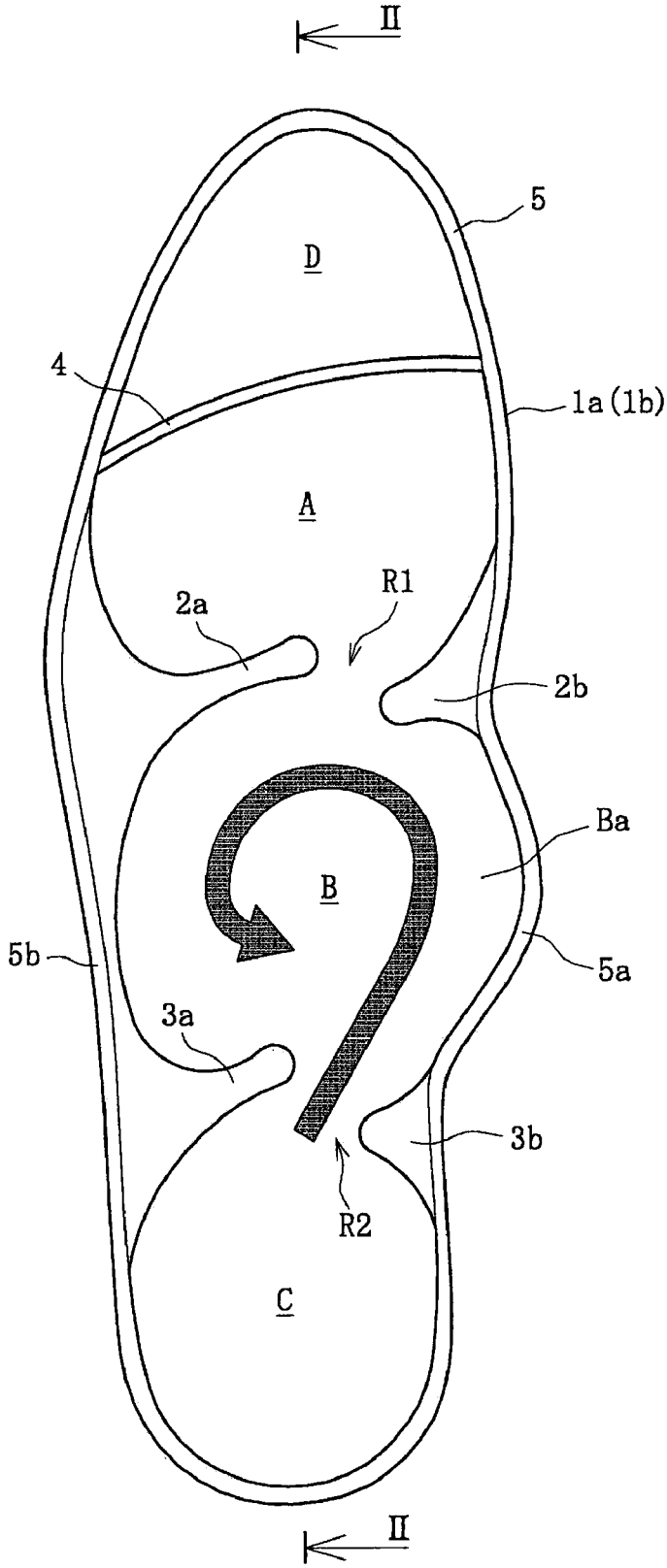
FIG. 1 is a plan view of an inner sole according to a first preferred embodiment.
Figure 2:
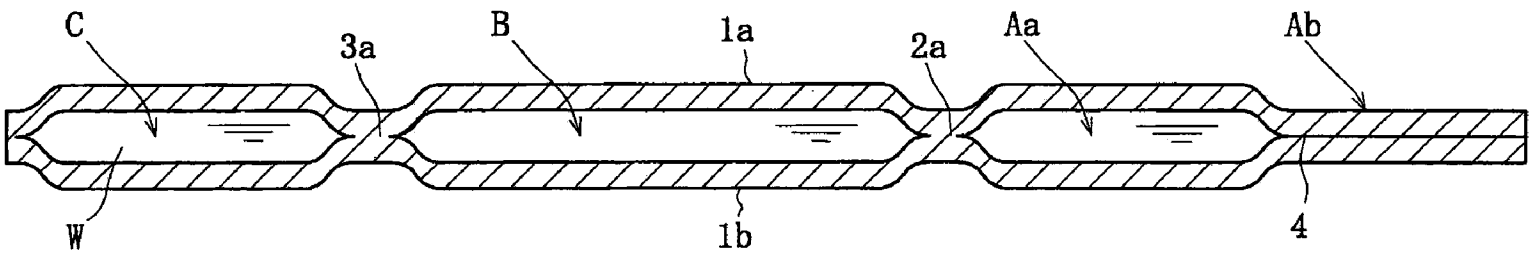
FIG. 2 is a cross-sectional view taken along line II-II of FIG. 1.

In FIGS. 1 and 2, an inner sole of the present disclosure is shown that is to be laid on an insole. A body of the inner sole includes an upper inner sole member 1*a* and a lower inner sole member 1*b*. The members 1*a*, 1*b* are adhered and sealed in a liquid tight manner to contain liquid, such as water W, with a first dam portions 2*a* and 2*b*, a second dam portion 3*a* and 3*b*, and a third dam portion 4.

Each of the upper and lower inner sole members 1*a* and 1*b* has a configuration substantially same as that of an insole of a shoe where they are laid. They are made of two flexible members, such as elastic and flexible synthetic resin sheets. The upper and lower inner sole members 1*a* and 1*b* are, for example, heat sealed at their edges so that a liquid containing space for containing liquid, such as water W, is formed between them. Material for forming the upper and lower inner sole members 1*a* and 1*b* can be selected from various other materials so long as the material has a predetermined durability and flexibility suitable for the inner sole.

The liquid W contained within the body of the inner sole is preferably an aqueous solution of polyhydric alcohol. This is an anti-freezing solution mixture of water and propylene glycol or the like. It includes 5~65 percentage by weight, more preferably 30~60 percentage by weight of propyleneglycol. The viscosity of the polyhydric alcohol is, at room temperature, within a range of 1~500 CP, preferably of 1~100 CP, more preferably 1~60 CP. The liquid contained within the body of the inner sole may be water only, including a case containing a trace additive or polyhydric only.

The first dam portions 2*a* and 2*b* and the second dam portions 3*a* and 3*b* are formed by heat welding the upper and lower inner sole members 1*a* and 1*b* to divide the liquid containing space into a toe region A, a heel region C and a middle region B between the two. The first dam portions 2*a* and 2*b* and the second dam portions 3*a* and 3*b* are arranged so that they form the toe region A, corresponding to a toe region of a shoe, the heel region C corresponding to a heel region of the shoe, and the middle region B, between the toe and heel regions of the shoe.

These dam portions 2*a* and 2*b*; and 3*a* and 3*b* extend to the inside of the inner sole from the adhered side edges 5*a* and 5*b* of the upper and lower inner sole members 1*a* and 1*b*. The dam portions 2*a*, 2*b*, 3*a*, 3*b* form orifices R1 and R2 as shown in FIG. 1. The dimension of each orifice R1 and R2 is set so that the liquid contained in the inner sole can flow at a predetermined flow rate between two adjacent regions divided by the dam portions 2*a* and 2*b* and 3*a* and 3*b*. Accordingly, when a load is applied to the heel region C, liquid contained in the heal region C flows into the middle region B and then into the toe region A through the orifices R2 and R1, respectively. When a load is applied to the toe region A, liquid contained in the toe region A flows into the middle region B and then into the heel region C through the orifices R1 and R2, respectively.

The toe region A, middle region B and heel region C as well as the orifices R1 and R2 according to the present disclosure makes it possible for the liquid (e.g. water) flowing from the heel region C into the middle region B or from the toe region A into the middle region B to respond to the timing of the walk during walking of a walker or wearer of the inner sole of the present disclosure. Thus, it is possible to improve the pressing effect to the sole of the foot of the walker.

A tip end region D is arranged at a fore side of the toe region A. Region D has a configuration corresponding to a toe region of a shoe. No liquid W is contained within the tip end region D. No liquid W can flow into the tip end region D. The tip end region D may be formed slightly larger along its periphery so as to be best fit into a shoe by adjusting the size of the inner sole, to that of the shoe, by cutting the periphery of the tip end region D using scissors or a knife.

The orifice R2 of the embodiment of the present disclosure opens toward a position near a right hand side edge 5*a* in FIG. 1. It corresponds to a shank portion of a shoe where the inner sole is laid to cause an eddy of liquid flowing from the heel region C into the middle region B substantially filling the whole or entire middle region B. The opening of the orifice R2 is deflected toward the side edge 5*a* relative to the longitudinal axis of the inner sole. Thus, the liquid W can flow as a large eddy, substantially filling the whole middle region B as shown by an arrow in FIG. 1, when a load is applied to the heel region C during walking. Accordingly, the liquid W tends to temporarily stay in the middle region B.

Accordingly, the temporary stay of the liquid W in the middle region B causes an inflation in the thickness direction (vertical direction) of the inner sole at the middle region B, that corresponds to the arch of a foot. The inflation in the region B firmly provides a pressing effect against the sole of a foot of the walker. In the embodiment illustrated in FIG. 1, the opening of the orifice R1 is deflected toward the side edge portion 5*b*. Thus, the eddy of the liquid W can also be caused in the middle region B when a load is applied to the toe region A during walking.

It is preferable to set an amount of the liquid W flowing from the heel region C to the middle region B, through the orifice R2, so that it can inflate the middle region B as large as possible at a specified walking speed. For example, it is preferable to form the orifice R2 so that more than 80% of the liquid W can be shifted from the heel region C to the middle region B within a specified walking speed (i.e. within constant time duration). Also, it is preferable to form the orifice R2 so that the liquid W can flow from the heel region to the middle region B at a flow rate of 4~25 ml/sec, more preferably 5~15 ml/sec.

A bulged portion Ba, with a substantially arc shape, is formed adjacent to the middle region B along the side edge 5*a* (the right hand side in FIG. 1). Thus, the liquid W flowing into the middle region B through the orifice R2 can be led into the middle region B along the bulged configuration of the bulged portion Ba.

When a load is applied to the heel region C by a heel of a walker, the liquid W flows from the heel region C into the middle region B through the orifice R2. This forms an eddy and thus the formed eddy causes inflation in the thickness direction of the inner sole especially in its bulged portion Ba that corresponds to the arch of a foot of the walker.

This vertical inflation of the bulged portion Ba can fill the gap between the arch of a foot of the walker and the bulged portion Ba. Thus, the body weight of the walker is supported by his (or her) whole sole, including the arch, during the supporting point of the body weight shift from the heel region C to the toe region A through the middle region B. According to the inner sole of the present disclosure, ideal shift of the liquid W to necessary regions of the inner sole can be achieved in accordance with the walking timing. Thus the shock applied to the sole of the walker can be reduced. In addition, since the generation of the eddy of the liquid W can also contribute to the increase of inflation of the middle region B, a sufficient pressing effect against the arch of a walker can also be achieved.

A second embodiment will be described with reference to FIG. 3.

Similarly to the first embodiment shown in FIGS. 1 and 2, the inner sole of this embodiment comprises, a body of the inner sole formed by adhering upper and lower inner sole members 1*a* and 1*b* in a sealed manner. A liquid W is contained within the members 1*a*, 1*b*. Also, first dam portions 2*a* and 2*b*, second dam portions 3*a* and 3*b*, and a third dam portion 4 are formed. Detailed description relating to those similar to the first embodiment will be omitted.

Figure 3:
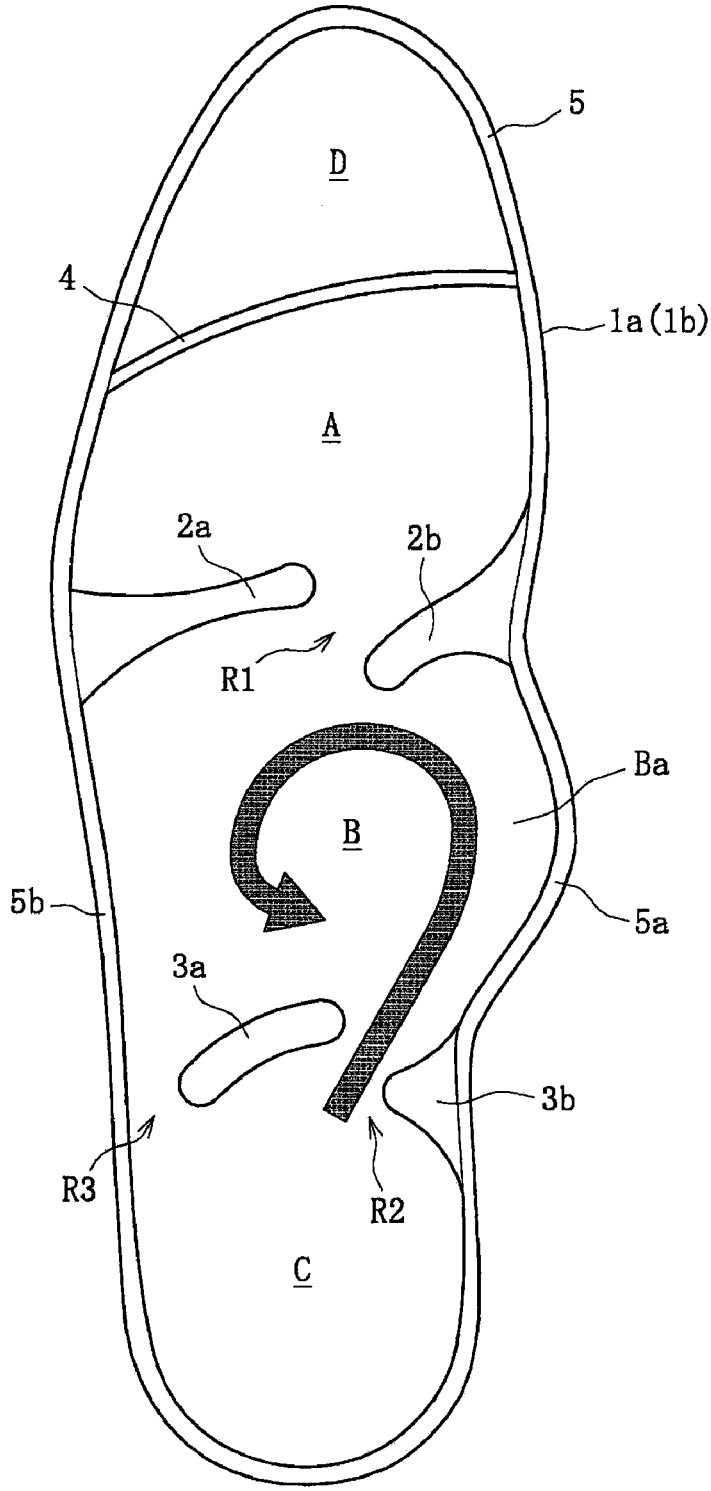
FIG. 3 is a plan view of an inner sole according to a second preferred embodiment.

As shown in FIG. 3, the second dam portion 3*a* on the left hand side is arranged separate, not only from the second dam portion 3*b* of the right hand side, but from the side edge portion 5*b* on the left hand side. It forms an orifice R3 between the two. The inflow of the liquid W from the heel region C to the middle region B is carried out mainly through orifice R2. Thus, the size of the orifice R3 is determined so that it does not substantially interfere with the generation of the eddy of the liquid W in the middle region B.

When a load is applied to the heel region C, the liquid W flows into the middle region B through the orifice R2. It forms an eddy substantially filling the whole of the middle region B, similar to the first embodiment. In this embodiment, the liquid W can additionally flow to the middle region B through the orifice R3 to relieve the shock applied to the heel region C. Thus, it is possible to achieve both a reduction of shock applied to the sole of a walker and an increase of the pressing effect against the arch of the walker.

A third embodiment will be described with reference to FIG. 4.

Similarly to the previous embodiments, the inner sole of this embodiment includes a body of an inner sole formed by adhering upper and lower inner sole members 1*a* and 1*b* in a sealed manner. The members 1*a*, 1*b* contain a liquid W. First dam portions 2*a* and 2*b*, second dam portions 3*a* and 3*b*, and a third dam portion 4 are formed. Detailed description relating to those similar to the second embodiment will be omitted.

Figure 4:
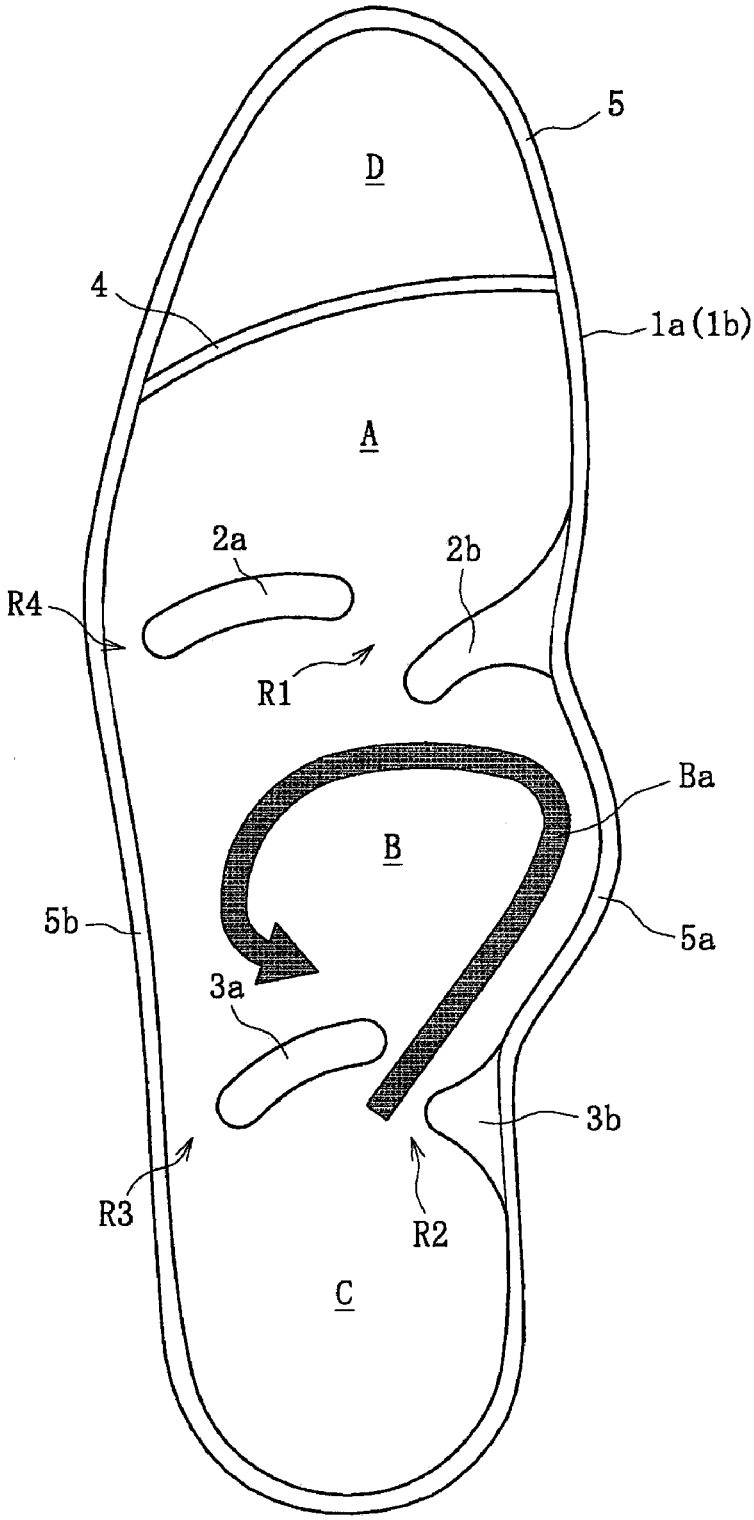
FIG. 4 is a plan view of an inner sole according to a third preferred embodiment.

As shown in FIG. 4, the first dam portion 2*a* on the left hand side is arranged separate not only from the first dam portion 2*b* on the right hand side, but from the side edge portion 5*b* of the left hand side. It forms an orifice R4 between the two. When a load is applied to the toe region A, the liquid W flows from the toe region A into the middle region B through the orifices R1 and R4. Thus, an eddy of the liquid W substantially filling the whole of the middle region B similarly to the first embodiment is created.

A fourth embodiment will be described with reference to FIG. 5.

Similarly to the previous embodiments, the inner sole of this embodiment includes a body of inner sole formed by adhering upper and lower inner sole members 1*a* and 1*b* in a sealed manner. They contain a liquid W. First dam portions 2*a* and 2*b*, second dam portions 3*a* and 3*b*, and a third dam portion 4 are formed. However, this embodiment is not provided with a bulged portion like those shown in the previous embodiments. Also in this embodiment, it is possible to cause a substantial eddy of the liquid W in the middle region B, as shown by an arrow in FIG. 5, when a load is applied to the heel region C. Thus, this improves the pressing effect against the arch of the walker.

Figure 6:
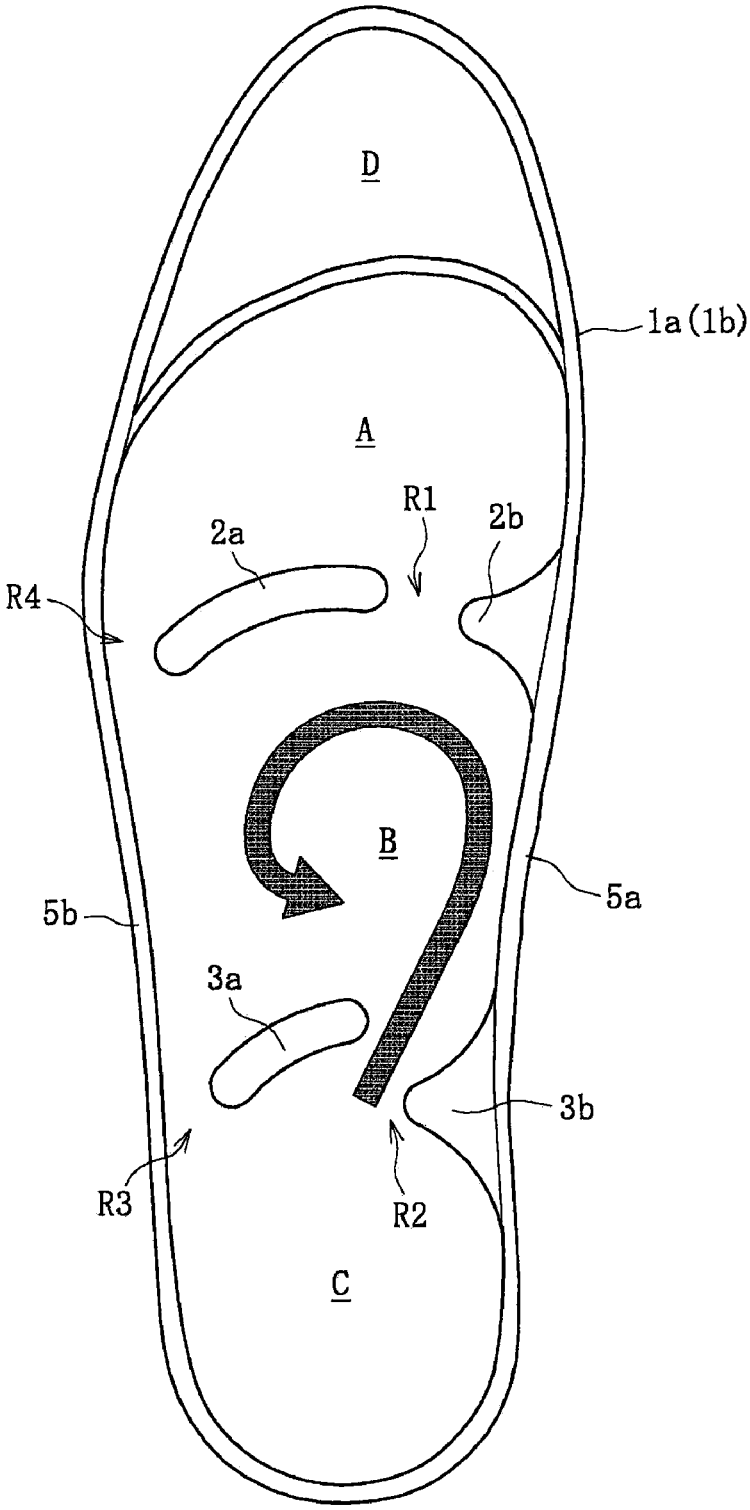
FIG. 6 is a plan view of an inner sole of a further preferred embodiment.

A fifth embodiment will be described with reference to FIG. 6.

Figure 5:
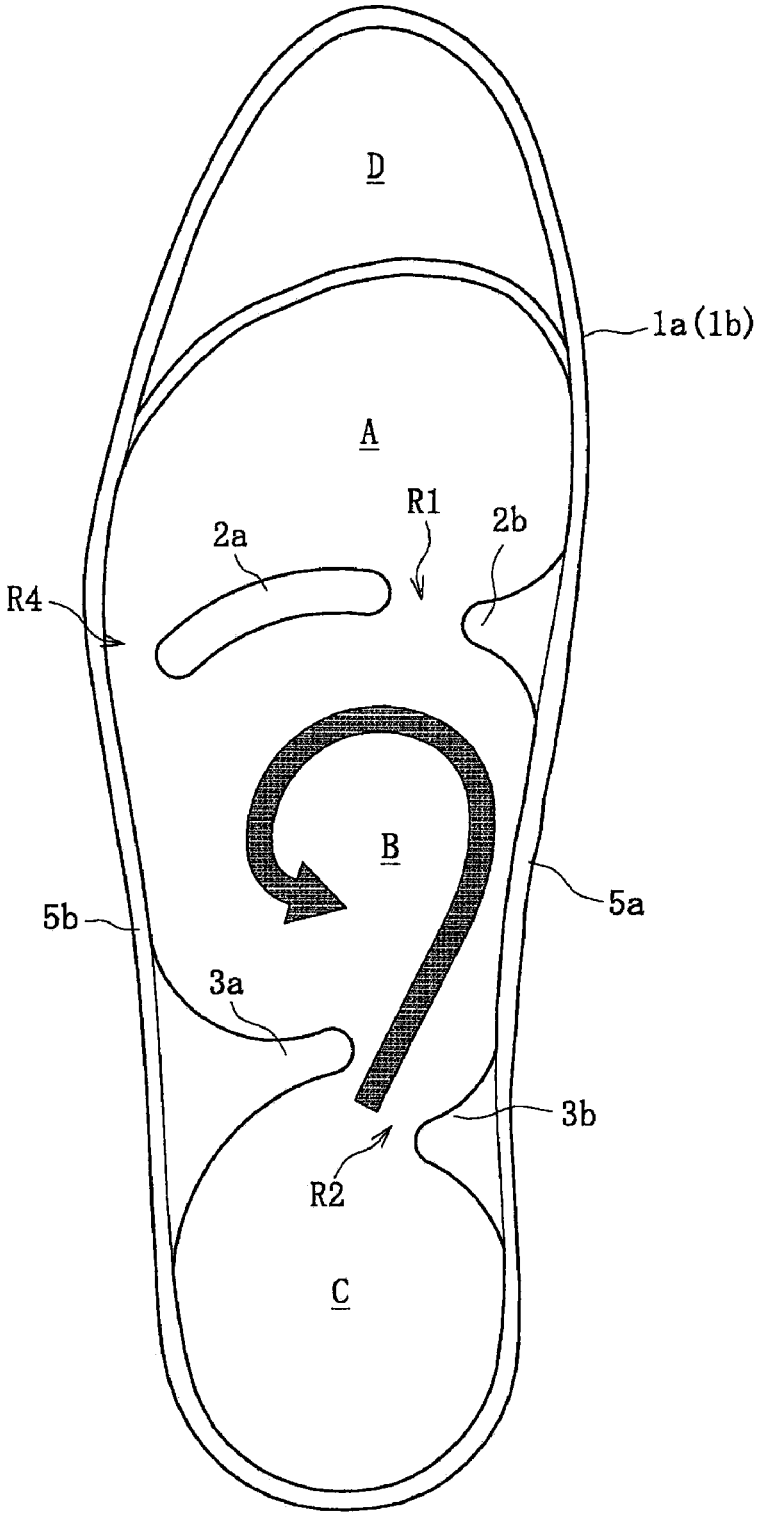
FIG. 5 is a plan view of an inner sole of another preferred embodiment.

This embodiment is a modification of the fourth embodiment shown in FIG. 5. The difference from the fourth embodiment is that the dam portion 3*a* on the left hand side is separate from the side edge portion 5*b* of the left hand side to form orifices R2 and R3.

Other embodiments of the present disclosure will be described with reference to FIGS. 7~11.

Figure 7:
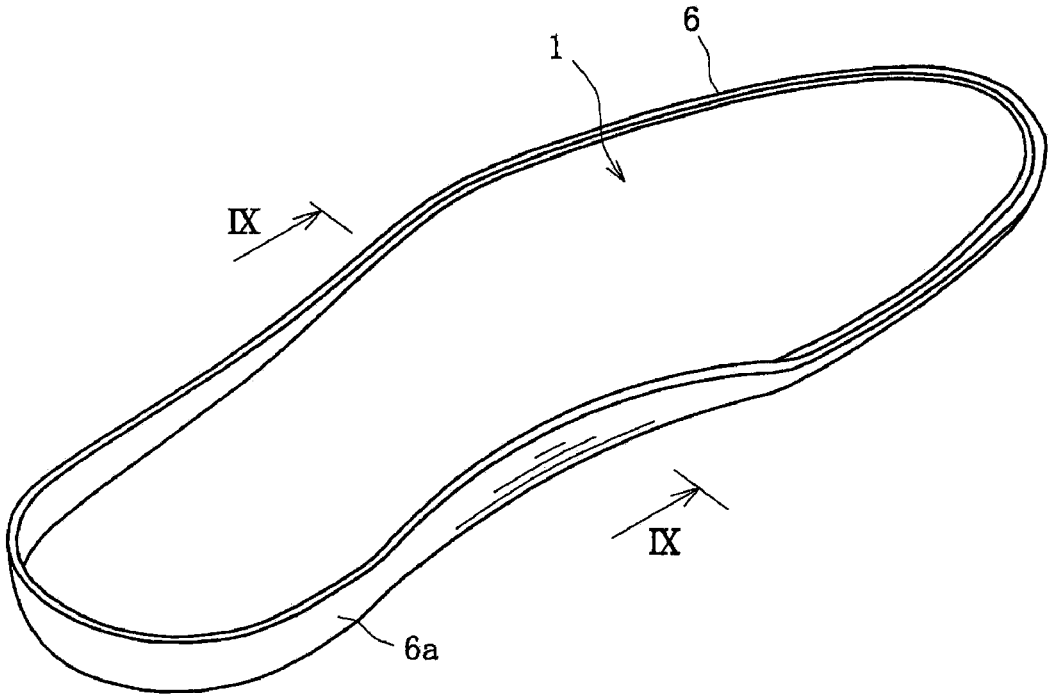
FIG. 7 is a perspective view of an inner sole of an embodiment using a cup-inner sole.
Figure 8:
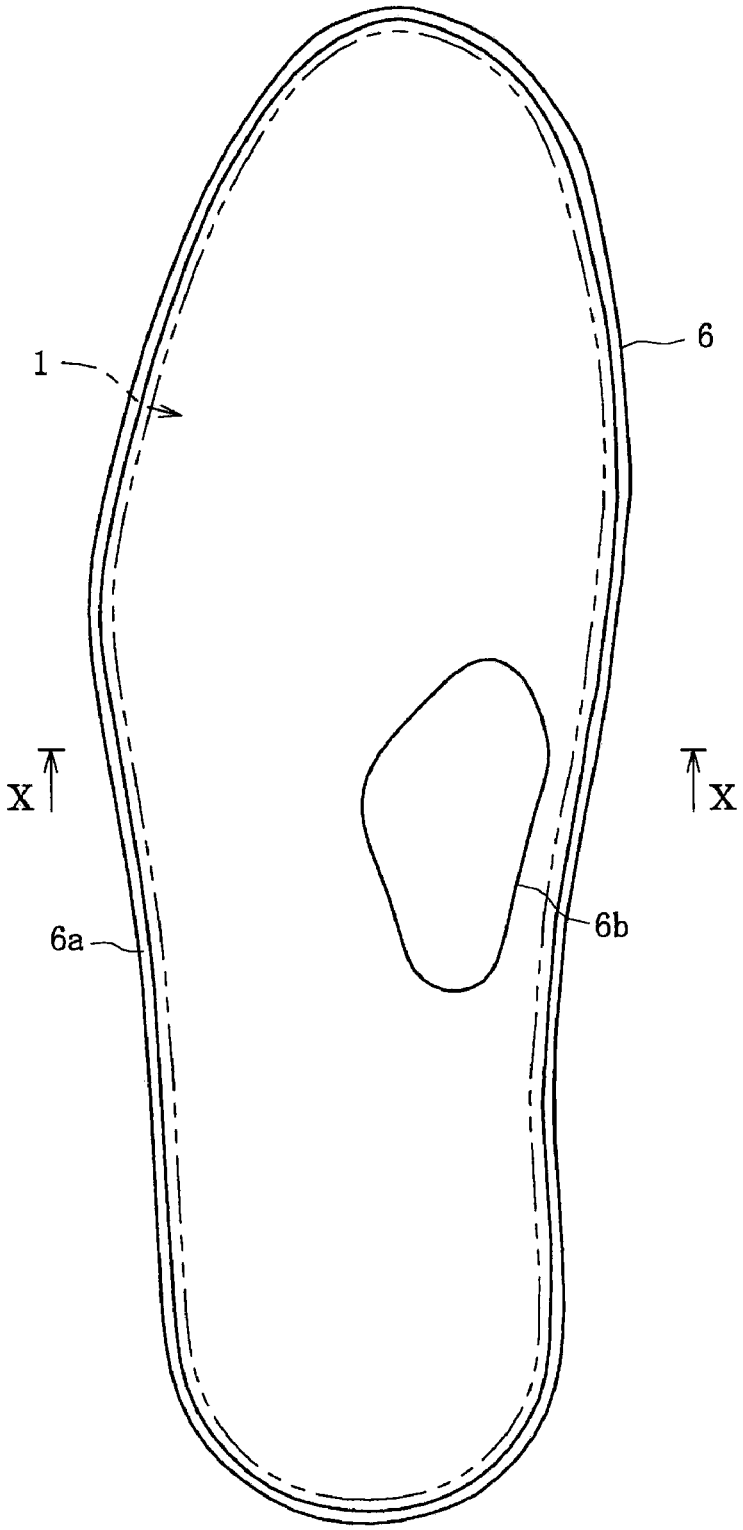
FIG. 8 is a schematic plan view of an inner sole of another embodiment using a cup-inner sole.
Figure 9:
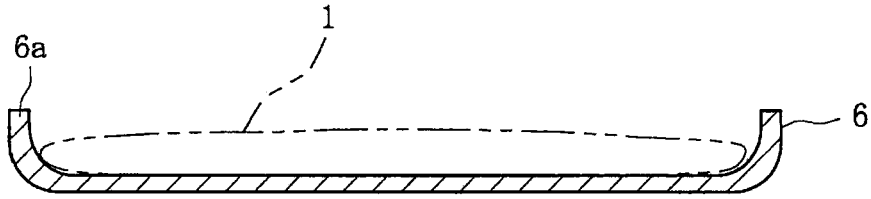
FIG. 9 is a schematic cross-sectional view taken along a line IX-IX of FIG. 7.
Figure 10:
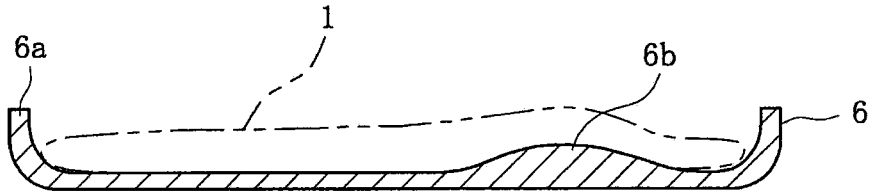
FIG. 10 is a schematic cross-sectional view taken along a line X-X of FIG. 8.
Figure 11:
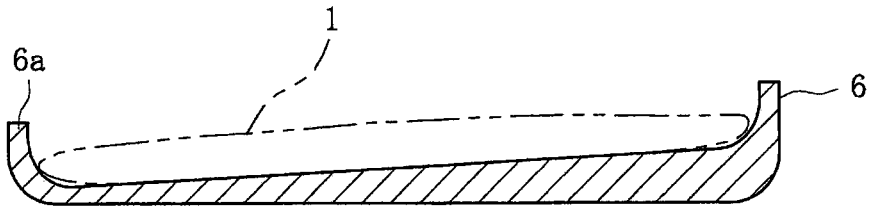
FIG. 11 is a schematic cross-sectional view of an inner sole of a further embodiment using a cup-inner sole.

These embodiments are formed by a combination of either one of the inner sole 1 described above or a cup-inner sole 6 made of a plastic molding. They have a vertically projected edge portion 6*a* formed as a 3-dimension configuration as shown in FIGS. 7 and 9. The inner sole 1 can be fit into the cup-inner sole 6 and laid as a unit on an insole of a shoe. The embodiment shown in FIGS. 8 and 10 has a partially raised portion 6*b* in a vertical, thickness, direction of the cup-inner sole 6 in addition to the vertically projected edge portion 6*a*. According to this embodiment, it is possible to further improve the pressing effect in any position against the sole of the walker by the partially raised portion. A further embodiment shown in FIG. 11 has an inclined top (or bottom) surface in addition to the vertically projected edge portion 6*a*. The combination of the inner sole 1 and the cup-inner sole may be covered by any material such as a cloth.

An experiment for proving the effects of the inner sole of the present disclosure will be described.

Figure 12:
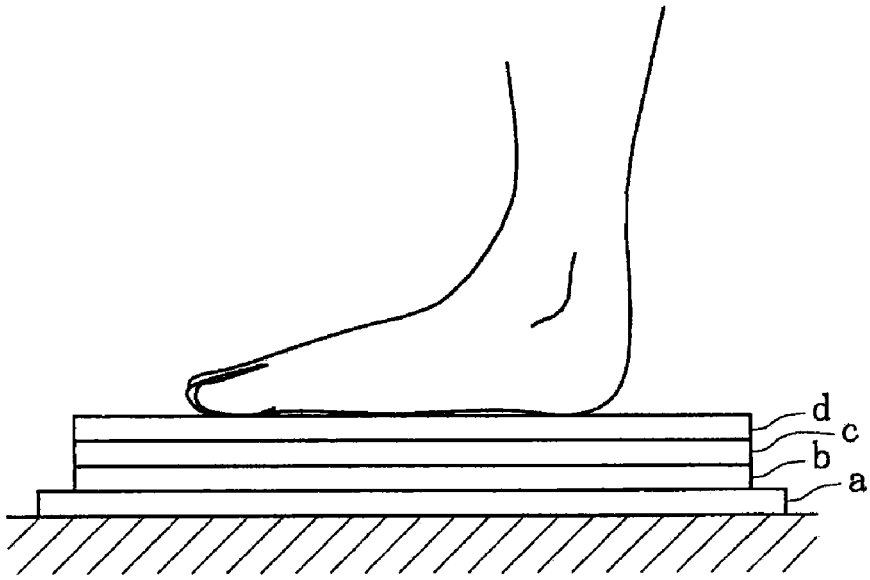
FIG. 12 is a schematic view showing an embodiment of an experiment for proving effects obtained by the inner sole of the present disclosure.
Figure 13:
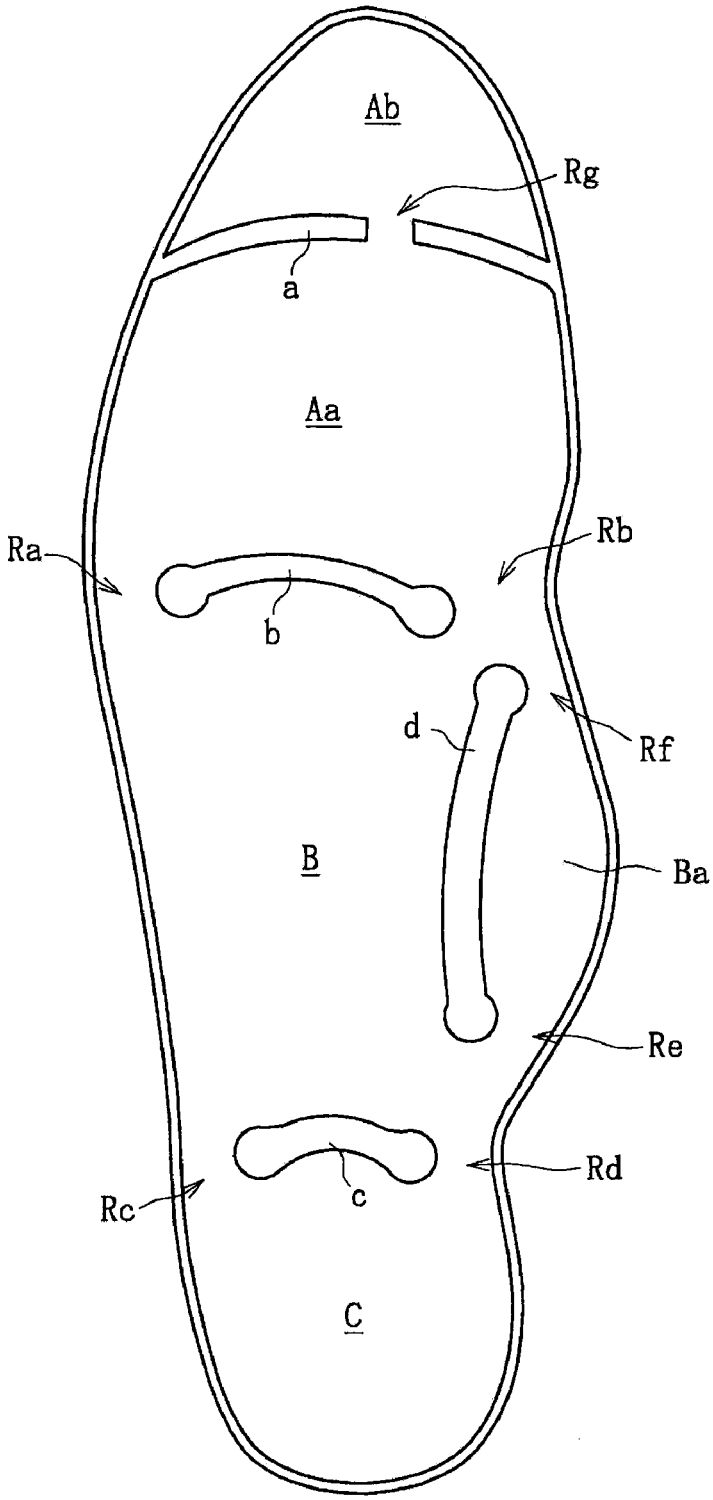
FIG. 13 is a schematic view of an inner sole used in the experiment of FIG. 12 as a second comparative example.

In this experiment, as shown in FIG. 12, a sheet member "a" of a hard synthetic resin is laid on a floor. An inner sole "b" submitted for the experiment (omitted in case of experiment as to bare foot), a thin leather member "c" and a sensor sheet "d" are laid successively on the sheet member "a". In this experiment, the inner sole of the first embodiment (FIG. 1) is termed as "Embodiment 1". The inner sole of the second embodiment (FIG. 3) is termed "Embodiment 2". The inner sole of the third embodiment (FIG. 4) is termed as "Embodiment 3". The bare foot is termed as "Comparative Example 1". An inner sole shown in FIG. 13 is termed as "Comparative Example 2".

In the "Comparative Example 1", the experiment was carried out by measuring the pressure distribution while laying a bare foot on the sensor sheet "d" laid on a thin leather member "c". The inner sole used as the "Comparative Example 2", as shown in FIG. 13, has a dam portion "b" for dividing a toe region A and a middle region B. A dam portion "c" divides the middle region B and a heel region C. A dam portion "d" divides the middle region B and a bulged portion Ba. A dam portion "a" divides the toe region Aa and a second toe region Ab. Orifices Ra~Rg are formed by the dam portions "a"~"d". The size, configuration and material, etc. are same as those in the embodiments 1~3.

Contacting area between the inner sole and the sole of a foot as to the Comparative Example 1 and 2 and the Embodiments 1~3 are measured by laying the foot on the sensor sheet "d" so that the body weight is applied substantially evenly on the sensor sheet "d". The obtained results are shown in Table 1 below.

TABLE 1

| | Contacting Area ($m^2$) |
|---|---|
| Comparative Example 1 | $0.92 \times 10^{-2}$ |
| Comparative Example 2 | $1.16 \times 10^{-2}$ |
| Embodiment 1 | $1.22 \times 10^{-2}$ |
| Embodiment 2 | $1.22 \times 10^{-2}$ |
| Embodiment 3 | $1.24 \times 10^{-2}$ |

As can be seen from Table 1, it is appreciated that the contacting area in either of the Embodiments 1~3 is larger than that in the Comparative Examples 1 and 2. Thus, body weight can be substantially evenly distributed on the inner sole in order to reduce the shock applied to the sole of the foot. Especially, the contacting area in the arch of the foot is increased. It has been proved from another experiment that the pressure in the arch of a foot was $0.2\times10^4$~$0.8\times10^4$ (kgw/$m^2$). Thus, it is appreciated that the arch of a foot can be pressed by an appropriate pressure and that the Embodiments 1~3 can improve the pressing function against the arch of the foot.

Figure 14:
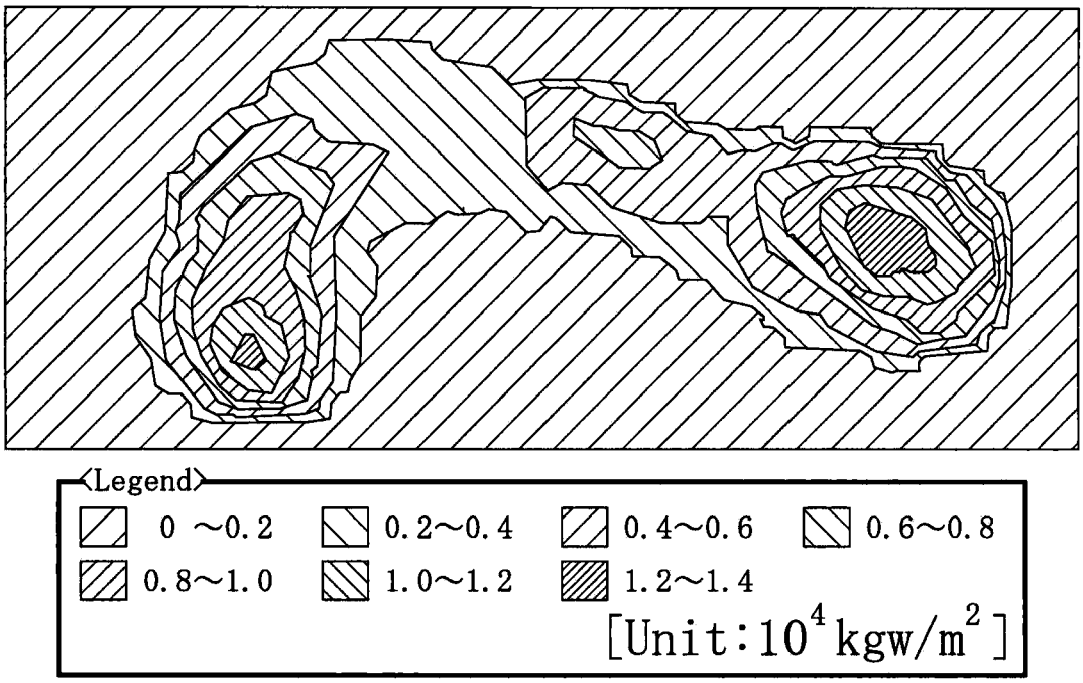
FIG. 14 is a diagrammatic view of a pressure distribution of an inner sole used in the experiment of FIG. 12 as a first comparative example.
Figure 15:
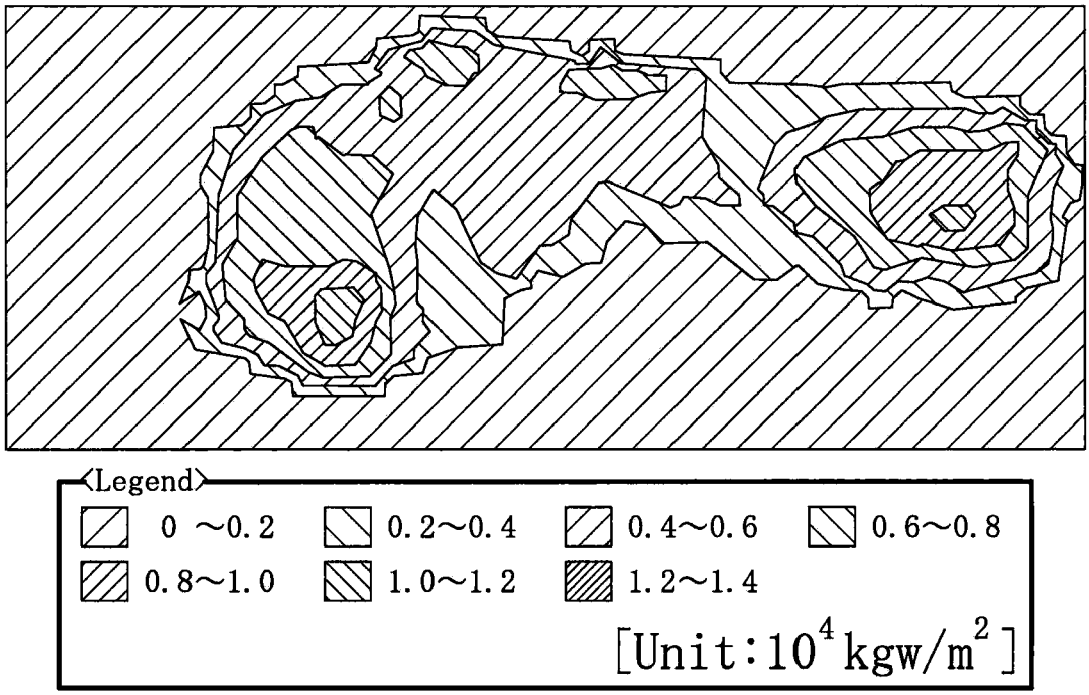
FIG. 15 is a diagrammatic view of a pressure distribution of an inner sole used in the experiment of FIG. 12 as a second comparative example.
Figure 16:
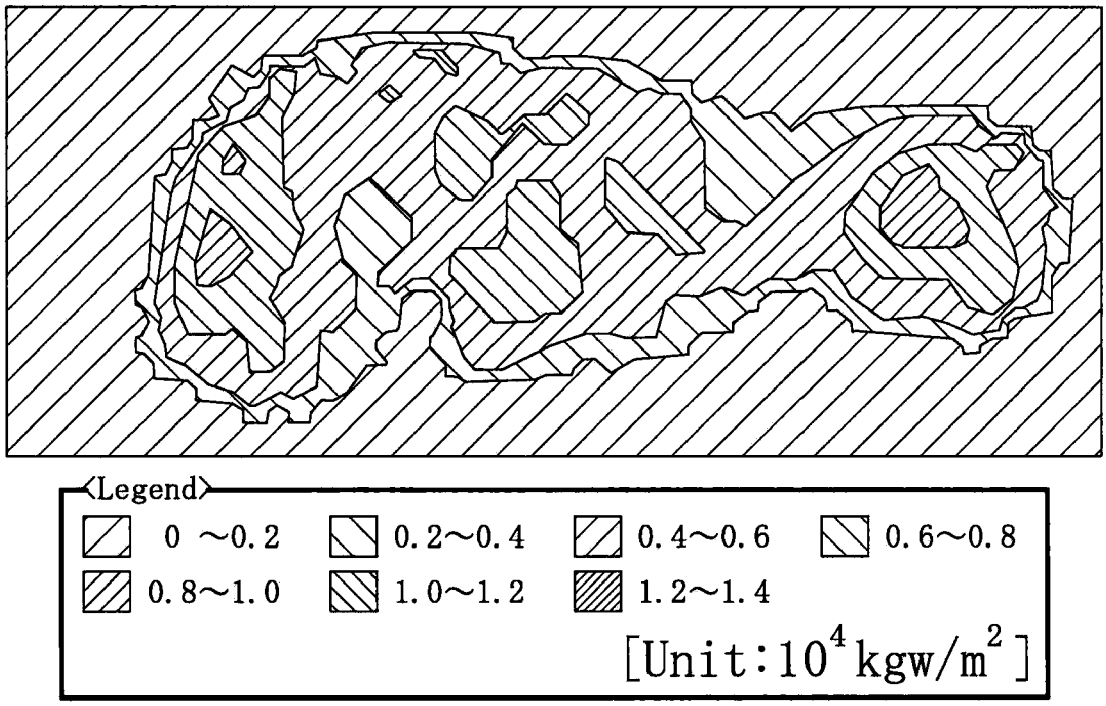
FIG. 16 is a diagrammatic view of a pressure distribution of an inner sole of a first embodiment of the present disclosure used in the experiment of FIG. 12.
Figure 17:
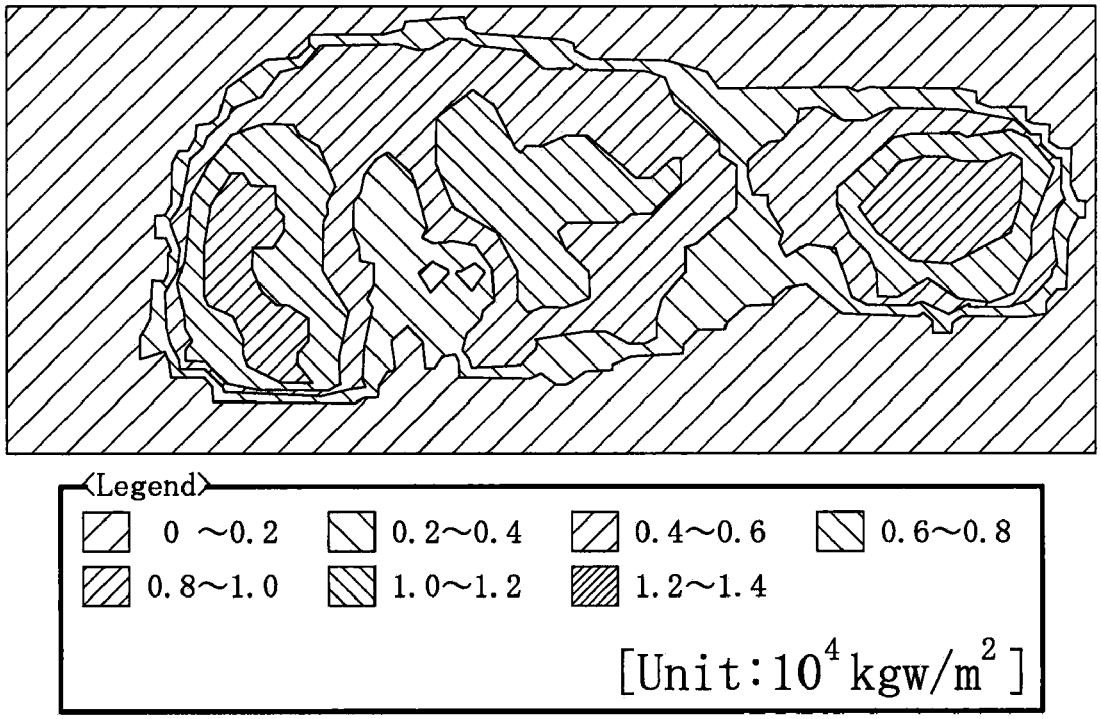
FIG. 17 is a diagrammatic view of a pressure distribution of an inner sole of a second embodiment used in the experiment of FIG. 12.
Figure 18:
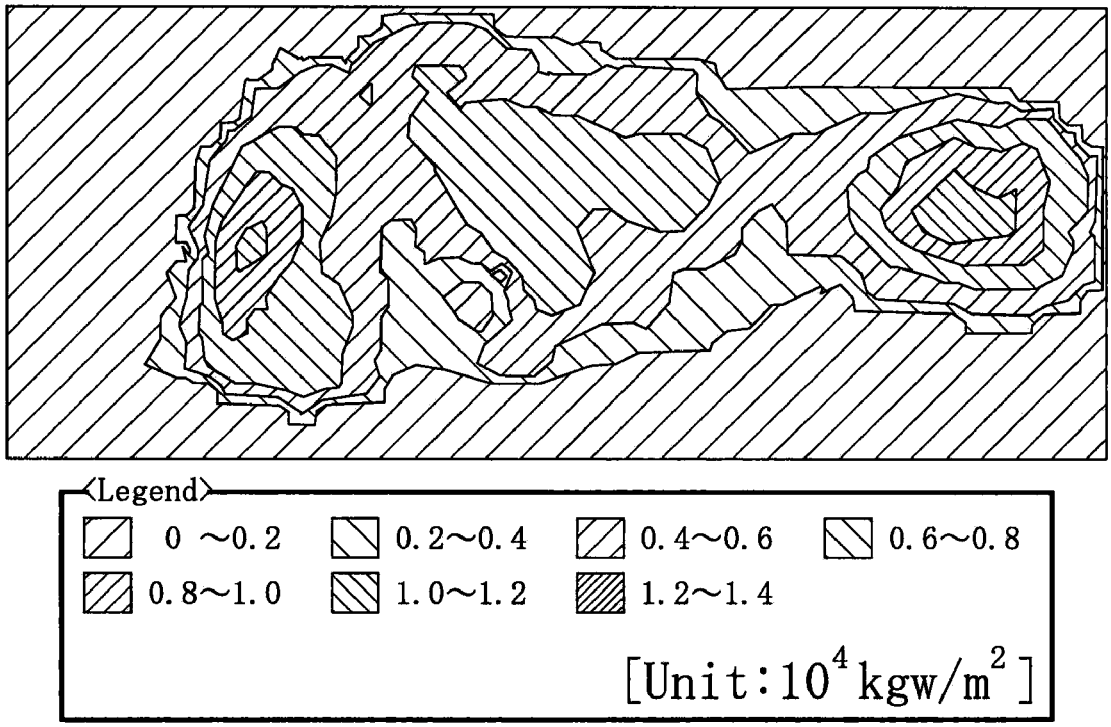
FIG. 18 is a diagrammatic view of a pressure distribution of an inner sole of a third embodiment used in the experiment of FIG. 12.
Figure 19:
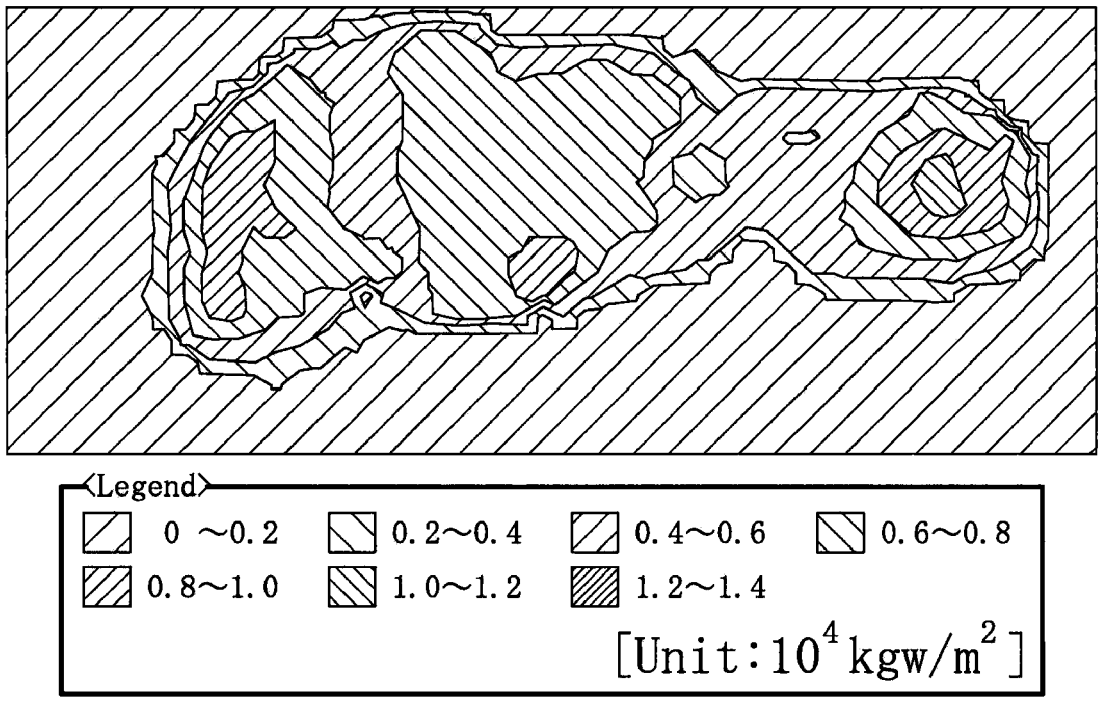
FIG. 19 is a diagrammatic view of a pressure distribution of an inner sole of a fourth embodiment used in the experiment of FIG. 12.
Figure 20:
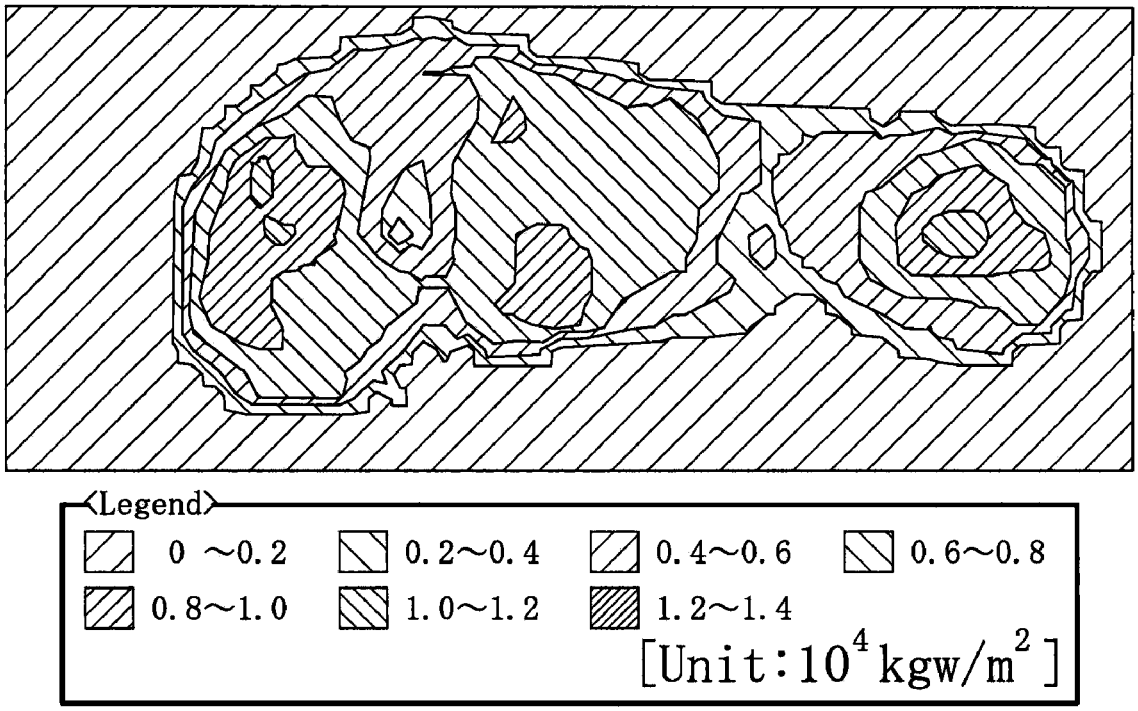
FIG. 20 is a diagrammatic view of a pressure distribution of an inner sole of a fifth embodiment used in the experiment of FIG. 12.

In another experiment, the pressure distribution was measured also as to the Embodiment 4 (embodiment shown in FIG. 5), Embodiment 5 (embodiment shown in FIG. 6) in addition to the Comparative Examples 1 and 2 and Embodiments 1~3. The obtained results are shown in FIGS. 14~20. FIGS. 14 and 15 show the pressure distribution, respectively, of the Comparative Examples 1 and 2. FIGS. 16~20 show the pressure distribution, respectively, of the Embodiments 1~5. From these results of the experiment, it can be appreciated that the pressure in the Embodiments 1~5 relieves the shock against the sole of a foot as compared with the Comparative Example 1 and 2. A distribution of the body weight is due to an increase of the contacting area at the arch of a foot.

Although several embodiments have been illustrated and described, the present disclosure is not limited to these embodiments. For example, an inner sole may be provided without any bulged portion in the region corresponding to the arch of a foot as shown in FIG. 5. In such an inner sole, it may be possible to provide a tip region D at a fore side of the toe region A in which no liquid W is contained in order to easily adjust the size of the inner sole to that of a shoe on which the inner sole is laid by appropriately cutting the tip region D.

In this inner sole, an eddy of the liquid W is caused to substantially fill the whole of the middle region B as shown by an arrow when a load is applied to the heel region C. Thus, it is possible to improve the pressing effect against the arch of a foot. In addition as shown in FIG. 6, it is possible to provide an inner sole where the dam 3*a* of the left hand side is separate from both the dam portion 3*b* of the right hand side and the side edge portion 5*b* to form orifices R2 and R3.

Although several embodiments have been illustrated and described, the present disclosure is not limited to these embodiments. For example, it is possible to use other liquid, such as oil, that has a predetermined viscosity in place of the liquid W. When water is used as the liquid W, it is possible to reduce the manufacturing cost of the inner sole. The body of the inner sole can be made of any other flexible material in place of synthetic resin sheet. However, when the body of the inner sole is made of flexible synthetic resin sheet, it is possible to smoothly cause vertical inflation of the inner sole in accordance with flowing of the liquid, to easily and firmly obtain the pressing effect, and to achieve easy cutting along the desirable outline of the inner sole and formation of dams.

The present disclosure can be applied to any inner sole where the orifice (or orifices) formed by the dams dividing the heel region and the middle region opens toward the side edge portion of the inner sole. The orifice causes an eddy of the liquid to fill whole the middle region, even if it has an outline different from those described and illustrated in the present specification or it has additional functions.

The present disclosure has been described with reference to the preferred embodiment. Obviously, modifications and alternations will occur to those of ordinary skill in the art upon reading and understanding the preceding detailed description. It is intended that the present disclosure be construed to include all such alternations and modifications insofar as they come within the scope of the appended claims or their equivalents.

What is claimed is:

1. An inner sole for footwear comprising:

a body of the footwear;

liquid containing spaces formed in the body of the footwear for sealingly and flowably containing a liquid;

dam portions for dividing the liquid containing spaces into a toe region, a heel region and a middle region between the heel and toe regions; and orifices for communicating the liquid between mutually adjacent regions;

at least one orifice, formed by said dam portions dividing the liquid containing spaces into the heel region and the middle region, configured to open toward an inner arch side edge portion of the body of the footwear, the at least one orifice configuration enables fluid exiting the heel region to be directed toward the inner arch side edge portion corresponding to an inner arch of the body of the footwear wherein said middle region is devoid of obstructions for enabling an eddy of liquid flowing from the heel region to all over the middle region to flow toward the inner arch side edge portion to substantially fill the whole middle region and wherein the middle region extends from the inner arch side edge of the body to an outer side edge.

2. The inner sole for footwear of claim 1 wherein the body of the footwear is a sandal.

3. An inner sole comprising:

a body of the inner sole made of flexible material and adapted to be laid on an insole of a shoe;

liquid containing spaces formed in the body of the inner sole for sealingly and flowably containing a liquid;

dam portions for dividing the liquid containing spaces into a toe region, a heel region and a middle region between the heel and toe regions; and orifices for communicating the liquid between mutually adjacent regions;

at least one orifice, formed by the dam portions for dividing the liquid containing spaces into the heel region and the middle region, configured to open toward an inner arch side edge portion of a shoe receiving the inner sole, the at least one orifice configuration enables fluid exiting the heel region to be directed toward the inner arch side edge portion corresponding to an inner arch of the body of the inner sole wherein said middle region is devoid of obstructions for enabling an eddy of liquid flowing from the heel region to all over the middle region to flow toward the inner arch side edge portion to substantially fill the whole middle region and wherein the middle region extends from the inner arch side edge of the body to an outer side edge.

4. The inner sole to be laid on an insole of a shoe of claim 3 wherein the orifice formed by the dam portions for dividing the liquid containing spaces into the heel region and the middle region opens toward a position near the side edge portion corresponding to a middle portion of the insole in a shoe on which the inner sole is laid.

5. The inner sole to be laid on an insole of a shoe of claim 3 wherein the body of inner sole is made of a flexible sheet of synthetic resin.

6. The inner sole to be laid on an insole of a shoe of claim 3 wherein the liquid is water or mixture of water and polyhydric alcohol.

7. The inner sole to be laid on an insole of a shoe of claim 3 wherein the body of inner sole is fit into a cup-inner sole having any three-dimensional configuration adapted to be laid on an insole of a shoe.

8. An inner sole for footwear comprising:

a body of the footwear;

liquid containing spaces formed in the body of the footwear for sealingly and flowably containing a liquid;

dam portions for dividing the liquid containing spaces into a toe region, a heel region and a middle region between the heel and toe regions; and orifices for communicating the liquid between mutually adjacent regions;

at least one orifice, formed by said dam portions dividing the liquid containing spaces into the heel region and the middle region, configured to open toward an inner arch side edge portion of the body of the footwear, the at least one orifice configuration enables fluid exiting the heel region to be directed toward the inner arch side edge portion corresponding to an inner arch of the body of the footwear wherein said middle region is devoid of obstructions for enabling an eddy of liquid flowing from the heel region to all over the middle region to flow toward the inner arch side edge portion to substantially fill the whole middle region and wherein the middle region extends from the inner arch side edge of the body to an outer side edge.

* * * * *